US011091979B2

(12) United States Patent
Yee et al.

(10) Patent No.: US 11,091,979 B2
(45) Date of Patent: Aug. 17, 2021

(54) METHOD AND APPARATUS FOR SETTING AN INTEGRATED HANGER AND ANNULAR SEAL BEFORE CEMENTING

(71) Applicants: Chee Kong Yee, Katy, TX (US); Carl Frederick Stockmeyer, III, Humble, TX (US); Mark Kendall Adam, Houston, TX (US)

(72) Inventors: Chee Kong Yee, Katy, TX (US); Carl Frederick Stockmeyer, III, Humble, TX (US); Mark Kendall Adam, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 122 days.

(21) Appl. No.: 16/429,495

(22) Filed: Jun. 3, 2019

(65) Prior Publication Data

US 2020/0378213 A1 Dec. 3, 2020

(51) Int. Cl.
*E21B 33/14* (2006.01)
*E21B 33/05* (2006.01)

(52) U.S. Cl.
CPC ..... *E21B 33/146* (2013.01); *E21B 33/05* (2013.01)

(58) Field of Classification Search
CPC ..... E21B 33/05; E21B 33/13; E21B 33/14; E21B 33/146; E21B 33/04
See application file for complete search history.

(56) References Cited

U.S. PATENT DOCUMENTS

| | | | | |
|---|---|---|---|---|
| 2,619,179 | A * | 11/1952 | Armentrout | E21B 34/14 166/104 |
| 3,273,646 | A | 9/1966 | Walker | |
| 4,969,517 | A | 11/1990 | Valka et al. | |
| 5,188,181 | A | 2/1993 | Brammer et al. | |
| 5,620,052 | A * | 4/1997 | Turner | E21B 33/043 166/208 |
| 6,871,708 | B2 | 3/2005 | Calder | |
| 8,109,333 | B2 | 2/2012 | Yee | |
| 9,869,157 | B2 | 1/2018 | Sevadjian et al. | |
| 9,945,202 | B1 * | 4/2018 | June | E21B 33/0407 |
| 2016/0281459 | A1 | 9/2016 | Stautzenberger et al. | |

OTHER PUBLICATIONS

International Search Report and Written Opinion for International Application No. PCT/US2020/030377; International Filing Date Apr. 29, 2020; dated Aug. 7, 2020 (pp. 1-10).

* cited by examiner

*Primary Examiner* — David Carroll
(74) *Attorney, Agent, or Firm* — Cantor Colburn LLP

(57) ABSTRACT

A method of performing an annular cementing operation after setting an integrated hanger and seal includes introducing a tubular including a flow passage having an inlet and an outlet into a wellbore, positioning and setting the integrated hanger and seal in the tubular, flowing cement between the tubular and the integrated hanger and seal into the inlet of the flow passage, passing the cement through the flow passage to the outlet, flowing the cement from the outlet, and closing the outlet.

19 Claims, 3 Drawing Sheets

METHOD AND APPARATUS FOR SETTING AN INTEGRATED HANGER AND ANNULAR SEAL BEFORE CEMENTING

BACKGROUND

In the resource exploration and recovery industry boreholes are formed in a formation for the purpose of locating and extracting formation fluids. Often times, a casing is installed in the wellbore to support the formation. After installation, cement is introduced into the wellbore between the formation and the casing. After cementing, a casing hanger annular seal is installed above the casing hanger. At times, cement may adhere to an inner surface of the casing.

In order to achieve a desired seal between the casing and the hanger, the cement must be removed. Thus, prior to installing the hanger seal, a cleaning operation is conducted to remove cement from inner surfaces of the casing in a zone desired to position the hanger seal. The need for the cleaning operation adds to an overall time and manpower requirement to form a completion and begin production from the wellbore. Therefore, the art would be open to new methods of forming a completion having fewer operations and require less manpower.

SUMMARY

Disclosed is a method of performing an annular cementing operation after setting an integrated hanger and seal including introducing a tubular including a flow passage having an inlet and an outlet into a wellbore, positioning and setting the integrated hanger and seal in the tubular, flowing cement between the tubular and the integrated hanger and seal into the inlet of the flow passage, passing the cement through the flow passage to the outlet, flowing the cement from the outlet, and closing the outlet.

Also disclosed is a resource exploration and recovery system including a first system, and a second system fluidically connected to the first system. The second system includes a tubular having an outer surface, and inner surface, and a flow passage formed in the tubular. The flow passage includes an inlet and an outlet. An integrated hanger and seal including an outer surface portion and an inner surface portion is secured to the inner surface of the first tubular. A valve is shiftable relative to the outlet. The valve is arranged on one of the inner surface of the tubular and the inner surface portion of the integrated hanger and seal.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
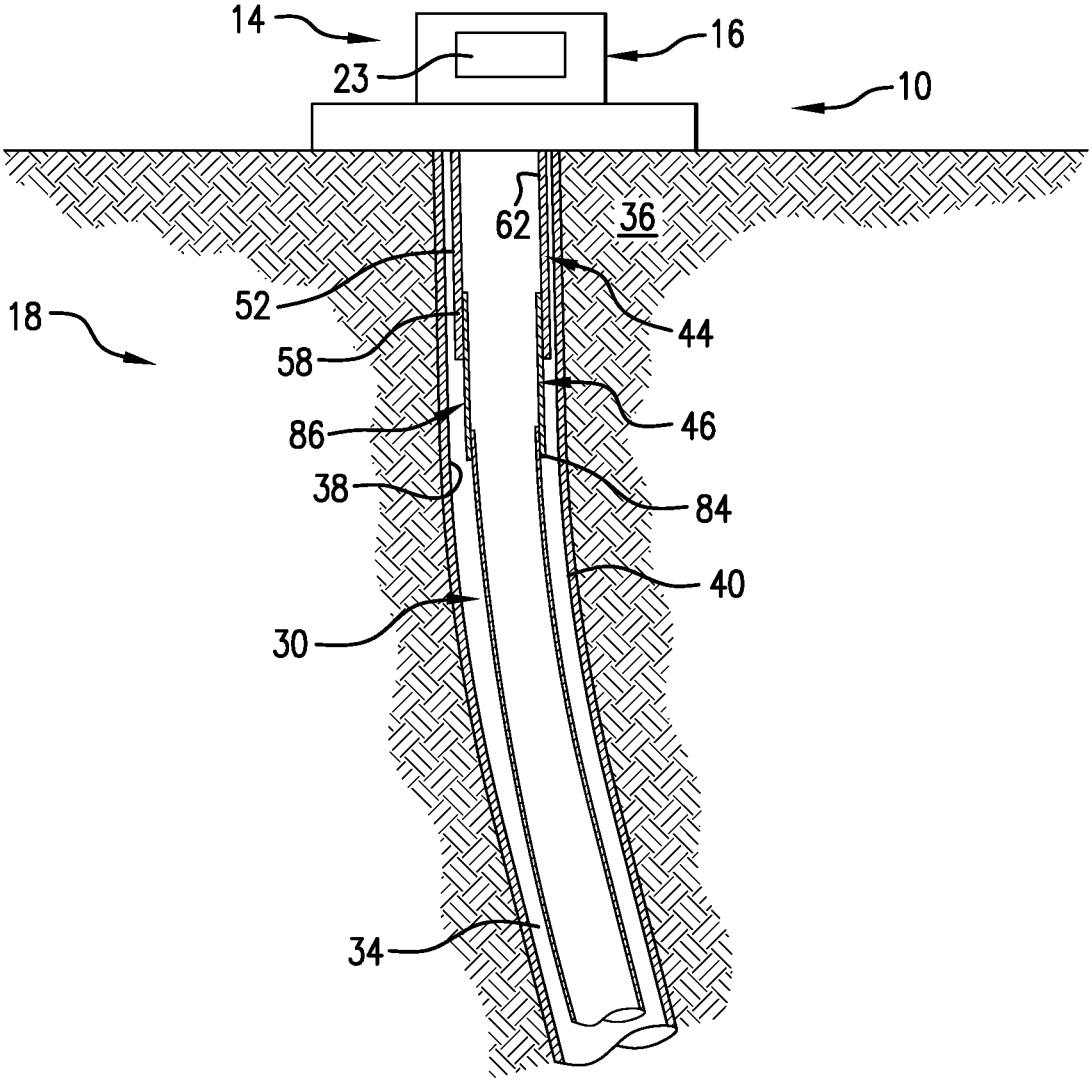
FIG. 1 depicts a resource exploration and recovery system including a hanger mounted to a tubular, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subsurface system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in a formation 36. Wellbore 34 includes an annular wall 38 defined by a casing tubular 40. Tubular string 30 may be formed by a series of interconnected discrete tubulars. Second system 18 may include a landing sub 44 that supports an integrated hanger and seal 46 which in turn supports tubular string 30.

Referring to FIGS. 2-5, landing sub 44, in accordance with an exemplary embodiment, takes the form of a tubular (not separately labeled) including a first end 56, a second end 58, an outer surface 60 and an inner surface 62. Inner surface 62 includes a slip receiving portion 64. Landing sub 44 includes a flow passage 68 that provides passage for cement to flow from an outer annulus about tubular string 30 during a cementing operation. Flow passage 68 includes an inlet 70 and an outlet 72 that is arranged between inlet 70 and surface system 16. Outlet 72 may be angled upwardly toward surface system 16.

Integrated hanger and seal 46 includes a first end portion 82, a second end portion 84, an outer surface portion 86, and an inner surface portion 88. A radially outwardly expandable slip 92 is provided on outer surface portion 86. Slip 92 is selectively engageable with slip receiving portion 64 to lock hanger 46 to landing sub 44. Integrated hanger and seal 46 also includes a seal 96 arranged on outer surface portion 86. Seal 96 engages with inner surface 62 of landing sub 44.

In accordance with an exemplary aspect, integrated hanger and seal 46 includes a flow port 98 that extends between outer surface portion 86 and inner surface portion 88. Flow port 98 is aligned with outlet 72 of flow passage 68 when integrated hanger and seal 46 is installed to landing sub 44 and slip 92 engages with slip receiving portion 64. In further accordance with an exemplary aspect, integrated hanger and seal 46 includes a valve 100 that may be selectively shifted to open and/or close cement communication through flow port 98.

Figure 5:
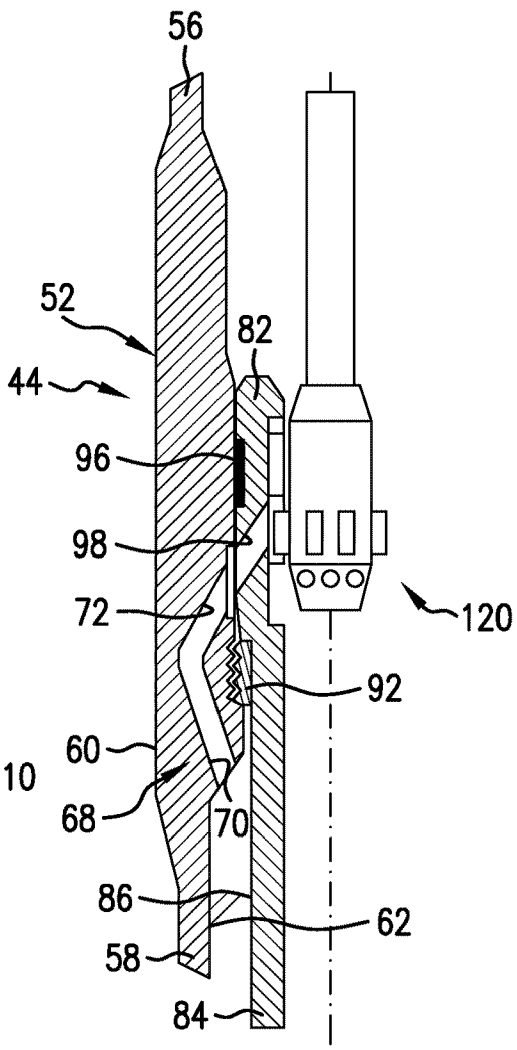
FIG. 5 depicts a valve mounted to the integrated hanger and seal being closed following cementing, in accordance with an aspect of an exemplary embodiment.
Figure 4:
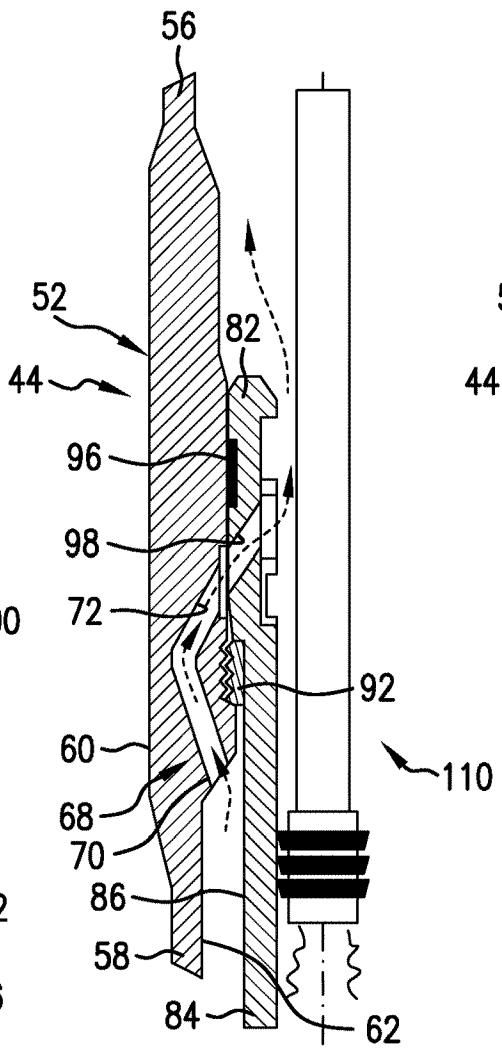
FIG. 4 depicts cement flowing between the landing sub and the integrated hanger and seal, in accordance with an aspect of an exemplary embodiment.
Figure 3:
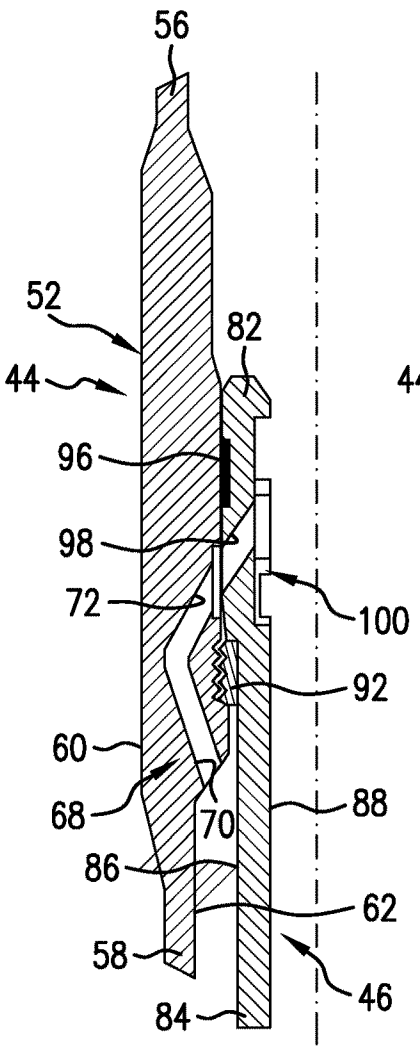
FIG. 3 depicts an integrated hanger and seal located and set in the landing sub, in accordance with an aspect of an exemplary embodiment.
Figure 2:
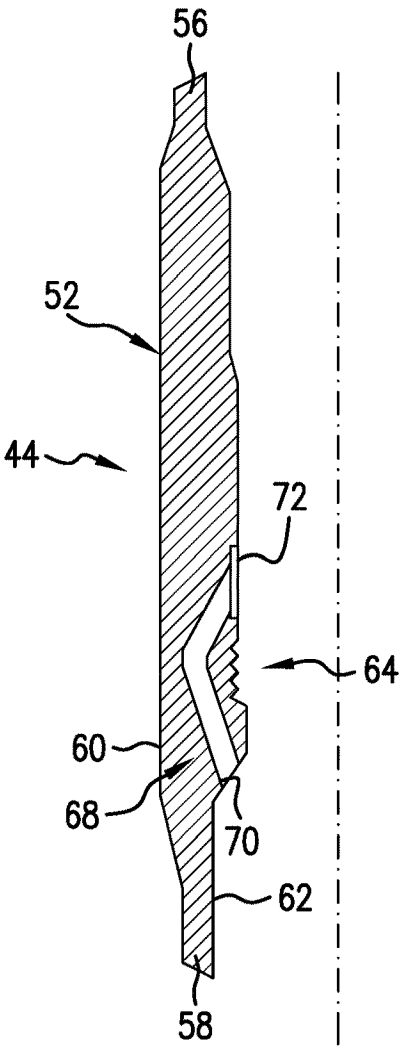
FIG. 2 depicts a partial cross-sectional side view of the tubular, shown in the form of a landing sub including a flow passage having an inlet and an outlet, in accordance with an aspect of an exemplary embodiment.

In accordance with an exemplary embodiment, integrated hanger and seal 46 is mounted to inner surface 62 of landing sub 44 and slip 92 is expanded radially outwardly into contact with slip receiving portion 64 as shown in FIG. 3. At this point, a cementing tool 110 may be guided into tubular string 30 and a cementing operation initiated as shown on FIG. 4. Cement will flow downwardly and eventually outwardly so as to fill a space between casing tubular 40 and tubular string 30. Cement will flow through flow passage 68 and pass through flow port 98. At this point, a shifting tool 120 may be guided into tubular string 30 and employed to close valve 100 as shown in FIG. 5. In this manner, the need to clean inner surface 62 of landing sub 44 prior to installing a hanger is avoided.

Figures 6, 7, 8, 9:
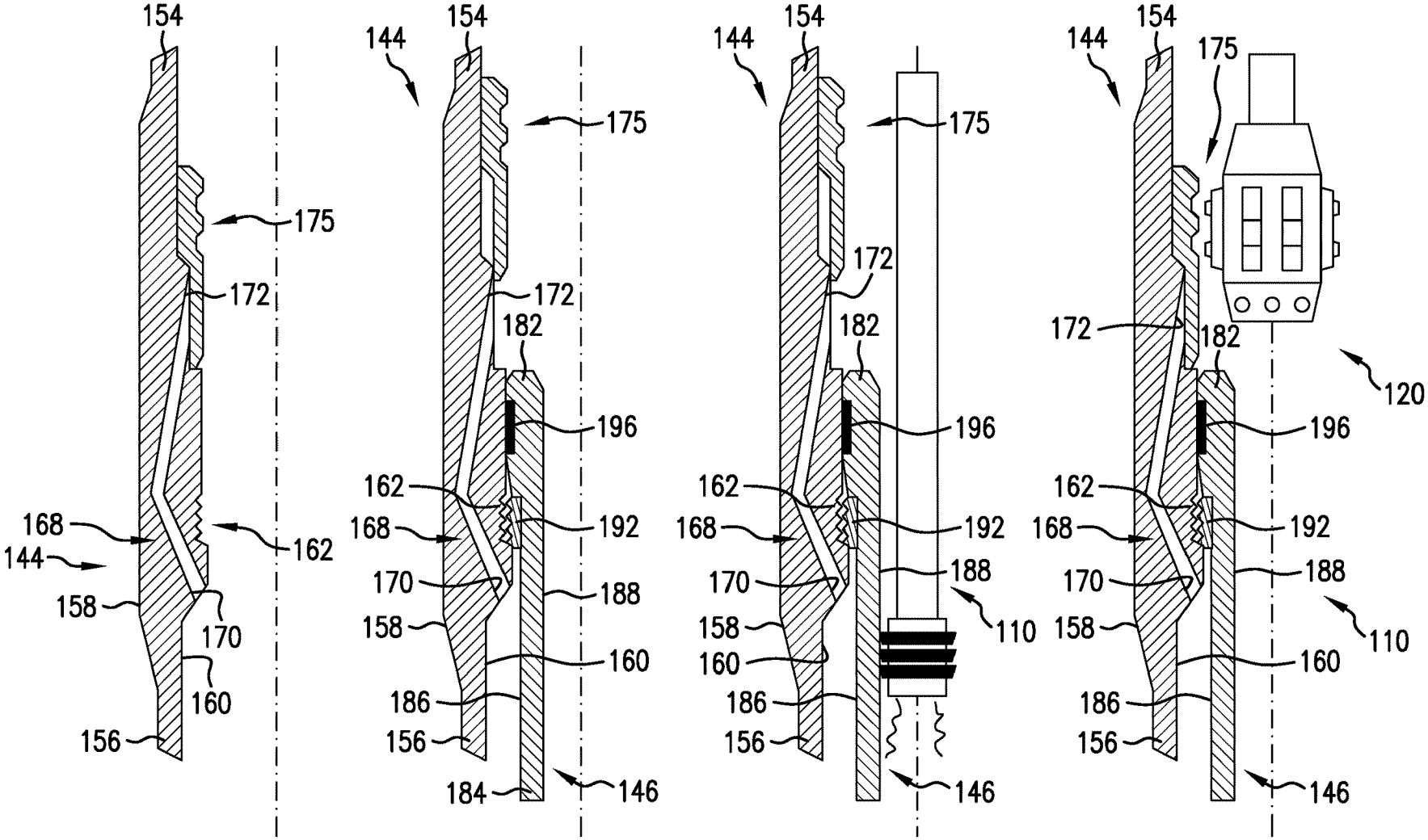
FIG. 6 depicts a partial cross-sectional side view of a tubular, shown in the form of a landing sub including a flow passage having an inlet and an outlet, in accordance with another aspect of an exemplary embodiment.
FIG. 7 depicts an integrated hanger and seal located and set in the landing sub of FIG. 6, in accordance with an aspect of an exemplary embodiment.
FIG. 8 depicts a cement bypass between the landing sub and the integrated hanger and seal of FIG. 7, in accordance with an aspect of an exemplary embodiment.
FIG. 9 depicts a valve mounted to the landing sub of FIG. 6 being closed following cementing, in accordance with an aspect of an exemplary embodiment.

Reference will now follow to FIGS. 6-9 in describing a landing sub 144 and integrated hanger and seal 146 in accordance with another aspect of an exemplary embodiment. As shown in FIG. 6, landing sub 144, in accordance with an exemplary embodiment, takes the form of a tubular (not separately labeled) including a first end 154, a second end 156, an outer surface 158 and an inner surface 160. Inner surface 160 includes a slip receiving portion 162.

Landing sub 144 includes a flow passage 168 that provides passage for cement to flow from an outer annulus about tubular string 30 during a cementing operation. Flow passage 168 includes an inlet 170 and an outlet 172 that is arranged between inlet 170 and surface system 16. Outlet 172 may be angled upwardly toward surface system 16. Landing sub 144 also includes a selectively shiftable valve 175 arranged upwardly of outlet 172. As will be detailed more fully herein, valve 175 may be closed over outlet 172 after cementing.

Hanger 146 includes a first end portion 182, a second end portion 184, an outer surface portion 186, and an inner surface portion 188. A radially outwardly expandable slip 192 is provided on outer surface portion 186. Slip 192 is selectively engageable with slip receiving portion 162 to lock hanger 146 to landing sub 144. Hanger 146 also includes a seal 196 arranged on outer surface portion 186. Seal 196 engages with inner surface 160 of landing sub 144.

In accordance with an exemplary embodiment, integrated hanger and seal 146 is mounted to inner surface 160 of landing sub 144 and slip 192 is expanded radially outwardly into contact with slip receiving portion 162 as shown in FIG. 7. At this point, cementing tool 110 may be guided into tubular string 30, valve 175 is opened as shown in FIG. 8 and a cementing operation initiated. Cement will flow downwardly and eventually outwardly so as to fill a space between casing tubular 40 and tubular string 30. Cement will flow through flow passage 168. At this point, shifting tool 120 may be guided into tubular string 30 and employed to close valve 175 as shown in FIG. 9. In this manner, the need to clean inner surface 62 of landing sub 44 prior to installing a hanger is avoided.

Set forth below are some embodiments of the foregoing disclosure:

Embodiment 1. A method of performing an annular cementing operation after setting an integrated hanger and seal comprising: introducing a tubular including a flow passage having an inlet and an outlet into a wellbore; positioning and setting the integrated hanger and seal in the tubular; flowing cement between the tubular and the integrated hanger and seal into the inlet of the flow passage; passing the cement through the flow passage to the outlet; flowing the cement from the outlet; and closing the outlet.

Embodiment 2. The method according to any prior embodiment, further comprising: flowing the cement from the outlet through a flow port in the integrated hanger and seal.

Embodiment 3. The method according to any prior embodiment, wherein closing the outlet includes shifting a valve mounted to the integrated hanger and seal relative to the flow port.

Embodiment 4. The method according to any prior embodiment, wherein closing the outlet includes shifting a valve mounted to the tubular relative to the outlet.

Embodiment 5. The method according to any prior embodiment, further comprising: forming the seal includes compressing an elastomeric seal of the integrated hanger and seal between an inner surface of the tubular and an outer surface of the integrated hanger and seal.

Embodiment 6. The method according to any prior embodiment, wherein forming the seal includes engaging a seal mounted to the integrated hanger and seal with the tubular uphole of the outlet.

Embodiment 7. The method according to any prior embodiment, wherein forming the seal includes engaging a seal mounted to the integrated hanger and seal with the tubular between the inlet and the outlet.

Embodiment 8. The method according to any prior embodiment, further comprising: locking the integrated hanger and seal to the tubular.

Embodiment 9. The method according to any prior embodiment, wherein locking the integrated hanger and seal includes expanding one or more slips radially outwardly into engagement with the tubular.

Embodiment 10. A resource exploration and recovery system comprising: a first system; a second system fluidically connected to the first system, the second system including: a tubular including an outer surface, and inner surface; a flow passage formed in the tubular, the flow passage including an inlet and an outlet; an integrated hanger and seal secured to the inner surface of the first tubular, the integrated hanger and seal including an outer surface portion and an inner surface portion, the integrated hanger and seal being; and a valve shiftable relative to the outlet, the valve being arranged on one of the inner surface of the tubular and the inner surface portion of the integrated hanger and seal.

Embodiment 11. The resource exploration and recovery system according to any prior embodiment, wherein the valve is mounted to the inner surface of the tubular.

Embodiment 12. The resource exploration and recovery system according to any prior embodiment, wherein the integrated hanger and seal includes a flow port aligned with the outlet.

Embodiment 13. The resource exploration and recovery system according to any prior embodiment, wherein the valve is mounted to the inner surface of the integrated hanger and seal and selectively shiftable relative to the flow port.

Embodiment 14. The resource exploration and recovery system according to any prior embodiment, further comprising: a seal arranged between the tubular and the integrated hanger and seal.

Embodiment 15. The resource exploration and recovery system according to any prior embodiment, wherein the seal is arranged between the inlet and the outlet of the flow passage.

Embodiment 16. The resource exploration and recovery system according to any prior embodiment, wherein the seal is arranged uphole of the outlet of the flow passage.

Embodiment 17. The resource exploration and recovery system according to any prior embodiment, further comprising: a radially outwardly expandable slip mounted to the outer surface portion of the integrated hanger and seal.

Embodiment 18. The resource exploration and recovery system according to any prior embodiment, further comprising: a slip receiving portion arranged on the outer surface of the tubular.

Embodiment 19. The resource exploration and recovery system according to any prior embodiment, wherein the slip receiving portion is arranged between the inlet and the outlet of the flow passage.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of performing an annular cementing operation after setting an integrated hanger and seal comprising:

introducing a tubular including a flow passage having an inlet and an outlet into a wellbore;

positioning and setting the integrated hanger and seal in the tubular;

flowing cement between the tubular and the integrated hanger and seal into the inlet of the flow passage;

passing the cement through the flow passage to the outlet;

flowing the cement from the outlet; and closing the outlet.

2. A The method of claim 1, further comprising: flowing the cement from the outlet through a flow port in the integrated hanger and seal.

3. A The method of claim 2, wherein closing the outlet includes shifting a valve mounted to the integrated hanger and seal relative to the flow port.

4. A The method of claim 1, wherein closing the outlet includes shifting a valve mounted to the tubular relative to the outlet.

5. A The method of claim 1, further comprising: forming the seal includes compressing an elastomeric seal of the integrated hanger and seal between an inner surface of the tubular and an outer surface of the integrated hanger and seal.

6. A The method of claim 5, wherein forming the seal includes engaging a seal mounted to the integrated hanger and seal with the tubular uphole of the outlet.

7. A The method of claim 5, wherein forming the seal includes engaging a seal mounted to the integrated hanger and seal with the tubular between the inlet and the outlet.

8. A The method of claim 1, further comprising: locking the integrated hanger and seal to the tubular.

9. A The method of claim 8, wherein locking the integrated hanger and seal includes expanding one or more slips radially outwardly into engagement with the tubular.

10. A resource exploration and recovery system comprising:

a surface system;

a subsurface system fluidically connected to the surface system, the subsurface system including:

a tubular including an outer surface, and inner surface;

a flow passage formed in the tubular, the flow passage including an inlet and an outlet;

an integrated hanger and seal secured to the inner surface of the tubular, the integrated hanger and seal including an outer surface portion and an inner surface portion, the integrated hanger and seal being; and a valve shiftable relative to the outlet, the valve being arranged on one of the inner surface of the tubular and the inner surface portion of the integrated hanger and seal.

11. The resource exploration and recovery system according to claim 10, wherein the valve is mounted to the inner surface of the tubular.

12. The resource exploration and recovery system according to claim 10, wherein the integrated hanger and seal includes a flow port aligned with the outlet.

13. The resource exploration and recovery system according to claim 10, wherein the valve is mounted to the inner surface of the integrated hanger and seal and selectively shiftable relative to the flow port.

14. The resource exploration and recovery system according to claim 10, further comprising: a seal arranged between the tubular and the integrated hanger and seal.

15. The resource exploration and recovery system according to claim 14, wherein the seal is arranged between the inlet and the outlet of the flow passage.

16. The resource exploration and recovery system according to claim 14, wherein the seal is arranged uphole of the outlet of the flow passage.

17. The resource exploration and recovery system according to claim 10, further comprising: a radially outwardly expandable slip mounted to the outer surface portion of the integrated hanger and seal.

18. The resource exploration and recovery system according to claim 17, further comprising: a slip receiving portion arranged on the outer surface of the tubular.

19. The resource exploration and recovery system according to claim 18, wherein the slip receiving portion is arranged between the inlet and the outlet of the flow passage.

* * * * *